US010197351B2

(12) United States Patent
Griffitts

(10) Patent No.: US 10,197,351 B2
(45) Date of Patent: Feb. 5, 2019

(54) BARREL STABILIZING AND RECOIL REDUCING MUZZLE BRAKE

(71) Applicant: James Norman Griffitts, Maryville, TN (US)

(72) Inventor: James Norman Griffitts, Maryville, TN (US)

( * ) Notice: Subject to any disclaimer, the term of this patent is extended or adjusted under 35 U.S.C. 154(b) by 0 days.

(21) Appl. No.: 15/855,333

(22) Filed: Dec. 27, 2017

(65) Prior Publication Data

US 2018/0135933 A1 May 17, 2018

Related U.S. Application Data

(63) Continuation of application No. 15/066,988, filed on Mar. 10, 2016, now Pat. No. 9,885,533.

(51) Int. Cl.
*F41A 21/32* (2006.01)
*F41A 21/34* (2006.01)
*F41A 21/36* (2006.01)

(52) U.S. Cl.
CPC ..... *F41A 21/36* (2013.01)

(58) Field of Classification Search
USPC ..... 42/1.06; 89/14.4, 14.3; 181/223
See application file for complete search history.

(56) References Cited

U.S. PATENT DOCUMENTS 618,901 A 2/1899 Peterson
785,974 A * 3/1905 McClean ..... F41A 5/26 89/14.3
1,174,165 A * 3/1916 Kenney ..... F41A 21/36 89/14.3
1,333,402 A * 3/1920 Galliot ..... F41A 21/36 89/14.3
1,363,058 A * 12/1920 Schneider ..... F41A 21/36 89/14.3
1,429,619 A * 9/1922 Nelson ..... F41A 21/36 89/14.3
1,502,558 A * 7/1924 Galliot ..... F41A 21/36 89/14.3
1,605,393 A * 11/1926 Cutts, Jr. ..... F41A 21/36 89/14.3
1,901,138 A * 3/1933 Barnes ..... F41A 21/36 89/14.3
1,948,496 A * 2/1934 Barnes ..... F41A 21/36 89/14.3
2,143,596 A * 1/1939 Galliot ..... F41A 21/36 89/14.3
2,192,081 A * 2/1940 Hughes ..... F41A 21/36 89/14.3
2,212,684 A 8/1940 Hughes
2,212,685 A * 8/1940 Hughes ..... F41A 21/36 89/14.3

(Continued)

*Primary Examiner* — Derrick R Morgan
(74) *Attorney, Agent, or Firm* — Pitts & Lake, P.C.

(57) ABSTRACT

A muzzle brake for high power rifles, hand guns, machine guns, and artillery, exhibiting barrel stabilization and recoil reduction, by capturing gasses against an orifice end plate and redirecting these gases both out of the muzzle brake, and into the muzzle brake to fill the partial vacuum left by the exiting high pressure gases, by way of Major truncated socket forms, and to a lesser extent, with the use of Minor truncated socket forms, and their associated vent ports in an asymmetrical pattern that balances barrel lift, and recoil against the expected and recovered gases.

15 Claims, 9 Drawing Sheets

(56) References Cited

U.S. PATENT DOCUMENTS 2,223,014 A * 11/1940 Galliot ..... F41A 21/36 89/14.3
2,403,007 A * 7/1946 Maris ..... F41A 21/36 89/14.3
2,451,514 A * 10/1948 Sieg ..... F41A 21/28 89/14.3
2,453,121 A * 11/1948 Cutts ..... F41A 21/36 42/79
2,742,821 A * 4/1956 Sweetman ..... F41A 21/16 42/76.01
2,842,024 A * 7/1958 Mutter ..... F41A 21/28 42/76.01
2,899,866 A * 8/1959 Clark ..... F41A 21/32 89/127
3,141,376 A * 7/1964 Chinn ..... F41A 21/36 89/14.3
3,202,056 A * 8/1965 Seeberger ..... F41A 21/325 89/14.3
3,492,912 A * 2/1970 Ashbrook ..... F41A 21/36 181/223
4,024,791 A * 5/1977 Stratman ..... F41A 21/34 89/14.2
4,545,285 A * 10/1985 McLain ..... F41A 21/36 89/14.3
D285,238 S * 8/1986 Cellini ..... 89/14.3
4,691,614 A * 9/1987 Leffel ..... F41A 21/36 89/14.3
4,852,460 A * 8/1989 Davidson ..... F41A 21/36 89/14.05
4,879,942 A * 11/1989 Cave ..... F41A 21/36 89/14.3
4,930,397 A * 6/1990 Seidler ..... F41A 21/325 89/14.3
4,945,812 A * 8/1990 Mazzanti ..... F41A 21/36 89/14.3
5,036,747 A * 8/1991 McClain, III ..... F41A 21/36 89/14.3
5,063,827 A * 11/1991 Williamson ..... F41A 21/26 89/14.3
D343,222 S * 1/1994 Morales ..... 89/14.3
5,279,200 A * 1/1994 Rose ..... F41A 21/32 42/97
5,320,022 A * 6/1994 Kimbro ..... F41A 21/36 89/14.3
5,333,529 A * 8/1994 Brockman ..... F41A 21/38 42/79
5,357,842 A * 10/1994 Reynolds ..... F41A 21/36 89/14.3
5,423,242 A * 6/1995 Schuemann ..... F41A 21/28 89/14.3
5,425,298 A * 6/1995 Coburn ..... F41A 21/38 89/14.3
5,844,162 A * 12/1998 Renner ..... F41A 21/18 42/51
6,516,698 B1 * 2/2003 Poff, Jr. ..... F41A 21/36 89/14.6
7,032,339 B1 4/2006 Bounds
7,600,461 B1 * 10/2009 Cler ..... F41A 21/36 89/14.3
7,954,414 B2 6/2011 Dueck et al.
8,250,962 B1 * 8/2012 Guenther ..... F41A 21/32 42/107
8,627,755 B1 1/2014 Eckel
8,695,475 B2 * 4/2014 Schneider ..... F41A 13/12 42/1.06
9,163,891 B1 * 10/2015 Dater ..... F41A 21/34
9,207,034 B2 * 12/2015 Larson, Jr. ..... F41A 21/36
2002/0117048 A1 * 8/2002 Sevastian ..... F41A 21/36 89/14.3
2004/0244571 A1 * 12/2004 Bender ..... F41A 21/38 89/14.3
2011/0226121 A1 * 9/2011 Peterson ..... F41A 21/36 89/14.3
2011/0271575 A1 * 11/2011 Overbeek Bloem ..... F41A 21/325 42/90
2012/0246987 A1 * 10/2012 Anthony ..... F41A 21/30 42/1.06
2013/0227871 A1 * 9/2013 Stone ..... F41A 21/30 42/76.1
2013/0233162 A1 * 9/2013 Schneider ..... F41A 13/12 89/14.3
2014/0165438 A1 * 6/2014 Wilkinson ..... F41C 27/22 42/1.06
2015/0308778 A1 * 10/2015 Vossler ..... F41A 21/34 89/14.3
2016/0209153 A1 * 7/2016 Dueck ..... F41A 21/32
2016/0334181 A1 * 11/2016 Bennington ..... F41A 21/32
2017/0059268 A1 * 3/2017 Sherrill ..... F41A 21/36
2017/0191782 A1 * 7/2017 Bray ..... F41A 21/34
2017/0299316 A1 * 10/2017 Vossler ..... F41A 21/34
2017/0343311 A1 * 11/2017 Deros ..... F41A 21/34

* cited by examiner

BARREL STABILIZING AND RECOIL REDUCING MUZZLE BRAKE

CROSS-REFERENCE TO RELATED APPLICATIONS

This application is a continuation of U.S. patent application Ser. No. 15/066,988, filed on Mar. 10, 2016, which is incorporated herein in its entirety by reference.

STATEMENT REGARDING FEDERALLY SPONSORED RESEARCH OR DEVELOPMENT

Not Applicable

FIELD OF THE INVENTION

The present general inventive concept pertains to firearms, and more particularly, to muzzle brakes of the type designed to control firearm recoil, barrel lift, and lateral deflection of hand guns, high power rifles, and other firearms during and after discharge of a projectile therefrom by capturing high pressure gas generated during discharge of the projectile and using the high pressure gas and atmospheric pressure gas that rushes back into the firearm barrel to fill the partial vacuum left in the firearm barrel due to the inertia of the high pressure gas leaving the barrel of the firearm.

BACKGROUND OF THE INVENTION

Firearms utilizing a barrel design, such as for example cannons, muskets, rifles, hand guns, and the like (hereinafter, collectively, "firearms") date back many centuries. By controlling and focusing the energy of the gases produced by rapidly burning a propellant, such as for example gun powder, these firearms are capable of propelling projectiles a great distance at a high velocity in a desired direction. Internal Ballistics of Guns is the science of turning the potential energy of a propellant into kinetic energy by burning, and thus releasing, hot high pressure gas to propel a projectile from a gun barrel. Research in this field of science, and now approved for public release by The United States Army Material Command, teaches authoritative reference information and data to aid scientists and engineers to design new weapons, accessories, and components for application to rifled, smooth bore and recoilless guns.

Physics reveals Newton's Third Law of Mechanics, known as the law of Action and Reaction. When a body is given a certain momentum in a given direction, some other body or bodies will get an equal momentum in the opposite direction. Newton's third law teaches that the substantial forces unleashed in a modern firearm barrel exhibit action and reaction as studied in the science of Internal Ballistics. Action and reaction are the forces of Internal Ballistics that are exploited and controlled by the present invention. Firing a projectile from the barrel of a firearm exerts a shock force over a very short time duration, and is experienced as recoil, also known as "kick back." The recoil, or rapid acceleration of the firearm imparted toward the breech end of a firearm by firing a projectile, imparts energy to the individual or mechanism holding the firearm and can be mild to devastating to the individual or mechanism holding the firearm, depending on the amount of energy involved, the mass and velocity of the propellant, the mass and velocity of the atmospheric air in front of the projectile, the mass and velocity of the projectile, and the mass of the firearm.

Over time, the shock force generated by firearm recoil can have a detrimental effect on the firearm and the optics or other sighting system used on the firearm. Also, over time, the shock force generated by firearm recoil impacts the mechanism and mounting points holding the weapon. This can be detrimental, for example, when a firearm is utilized in aircraft, mobile vehicles, or field mounted equipment. The same can also be applied to navel equipment. Recoil also contributes directly to the reduced control of the firearm, and over time results in damage to the mounting arrangement, leading to eventual failure. Movement of the firearm due to uncontrolled or poorly controlled recoil requires repositioning of the firearm and reacquisition of the target before another projectile can be fired.

Reduced recoil and reduced firearm movement allows much faster target reacquisition and precise control for quicker future shots. Reduced recoil and reduced firearm movement also allows greatly enhanced control of hand held and/or mounted full auto fire. Reduced wear and tear on the firearm and mounting system will provide an extended service life for the system.

In many prior art muzzle brake designs, the muzzle brake is typically attached to the muzzle end of a firearm by threading the exterior of the firearm barrel muzzle and threading the interior of the muzzle brake. This mounting method has long been established as a preferred method of attaching the muzzle brake to the muzzle end of a firearm barrel. Those skilled in the art will recognize that the thread size is dependent on the caliber of the firearm and the diameter of the barrel, whereas a larger caliber firearm typically requires a larger thread size on the muzzle end of the barrel and a corresponding larger internal thread in the end of the attachment muzzle brake body. A muzzle brake of this design may be removed and reattached at will. Alternate methods of attachment, such as silver solder, press fitting, and clamping to the external diameter of the muzzle end of the firearm are also known.

The United States Patent and Trademark Office has granted to inventors of muzzle brake designs a multitude of patents featuring varying chambers and vents for exhausting the rapidly expanding hot gases directly following the expulsion of the projectile from the muzzle of the gun barrel. Several prior art muzzle brake designs feature gas venting ports, and several designs feature a multitude of venting ports angled toward the shooter. Additional designs feature radial skew placements of venting ports relative to the bore centerline. Muzzle brake designs that incorporate vent ports that are perpendicular to the bore centerline are well known to engineers and builders of devices in an attempt to counter the recoil generated by firing a projectile from a firearm barrel. A list of prior art Patents is cited by reference patent numbers for comparison of features of prior art inventions by the many inventors that have contributed to the vast store of knowledge present in The United States Patent And Trademark Office, homage is paid to the many inventors who have made an effort to contribute to the wealth of technology maintained therein.

While many prior art muzzle brakes of the type referenced above are known in the art, and while many such prior art muzzle brakes are capable of at least slightly reducing the negative effects of recoil in firearms, such prior art designs are limited in their ability to control or eliminate a substantial portion of the recoil of a firearm. Thus, in using such prior art muzzle brakes, while a certain portion of the recoil of the firearm may be controlled or eliminated, significant recoil remains. Thus, in view of the above, there is a need in the art for an improved muzzle brake that allows for increased control and/or elimination of recoil and barrel movement resulting from high pressure expanding gas reacting against a projectile, acceleration of that projectile, and acceleration of the column of atmospheric gas in front of the projectile in modern firearms.

SUMMARY OF THE INVENTION

The present general inventive concept augments a firearm in the form of a precision muzzle brake exhibiting refinement of control of the kinetic energy of the atmospheric gas as it is being expelled in front of the projectile and the kinetic energy of the gas produced by the burning propellant behind the projectile to both reduce the recoil of the firearm and stabilize the firearm. Various embodiments of the firearm muzzle brake constructed in accordance with the present general inventive concept are of an advanced precision design that substantially reduces the recoil of a firearm, vertical deflection of the barrel, and the lateral movements of the firearm.

Various embodiments of the present general inventive concept may be achieved by providing an advanced firearm muzzle brake utilizing various modern alloy metals such as, chrome-molybdenum steel, precipitation hardening 17-4 stainless steel, 416 stainless steel, and other materials as appropriate in the manufacture of modern firearms. Various embodiments of a muzzle brake may be created as a device to be attached to the muzzle end of firearm, or alternatively may be created as an integral part of a firearm barrel. Various embodiments of a muzzle brake can be created in a variety of external and internal configurations, such as cylindrical, oval, square, and rectangular, but it will be recognized that the present general inventive concept is not limited to these forms.

In several embodiments, a firearm muzzle brake constructed in accordance with several features of the present general inventive concept features a gas capture chamber disclosing a chamber superior in size to the firearm barrel bore, with a caliber specific orifice end plate distal of the firearm barrel muzzle. The orifice end plate and the gas capture chamber are precision machined with a plurality of openings designed to capture and utilize the column of gas preceding the projectile and exiting the muzzle of the bore of the firearm.

In various embodiments, a plurality of openings into the gas capture chamber are provided, each opening extending at an angle towards the breech of the firearm. The many openings into the gas capture chamber form geometry conducive to the exploitation of the captured high pressure gas, thereby creating forward thrust on the muzzle brake and firearm, and thus reducing recoil. The number, geometric forms, and distribution of these openings also control muzzle rise and lateral movement when firing.

In various embodiments, the plurality of openings into the gas capture chamber partially penetrate into the gas capture chamber through the inner wall. In various embodiments, each of the openings defines a truncated socket form that presents a small area to capture part of the column of high pressure gas preceding the projectile exiting the muzzle of the bore of the firearm. The preferred form of the openings is cylindrical in shape with a spherical truncated socket form that does not penetrate to the full diameter of the cylindrical opening, thereby leaving a truncated spherical nozzle at the interface between the opening and the interior wall of the gas capture chamber. Thus formed, each of the openings captures and utilizes portions of the rapidly moving column of high pressure gas preceding the projectile in the First Event of the Internal Ballistics processes, as is defined more fully herein below.

As used herein, the "First Event of the Internal Ballistics processes," or "First Event," is where the majority of the column of high pressure gas preceding the projectile is captured by the gas capture chamber and utilized by the muzzle brake to reduce the recoil, muzzle rise, and lateral movement of the firearm. In the First Event, as a projectile leaves the bore of a firearm and travels through the muzzle brake, the column of high pressure gas preceding the projectile is acting as a fluid, and the muzzle brake utilizes the kinetic energy of this fluid to counter the recoil by acting against the caliber specific orifice end plate until the projectile exits the muzzle brake. As the projectile passes through the orifice in the muzzle brake end plate, the restriction at the orifice causes a substantial portion of the high pressure gas to be diverted into the major truncated socket forms and out and rearward by the forward most openings in the muzzle brake, whereupon this diverted high pressure gas imparts energy in a forward direction to the muzzle brake and to the firearm, thereby reducing recoil, muzzle rise, and lateral movement.

As used herein, the "Second Event of the Internal Ballistics processes," or "Second Event," is the restriction of the high pressure gases at the orifice end plate, whereby this forces a portion of the column of gas acting as a fluid to be expelled through the minor truncated socket forms that are the next set of openings towards the breech. A diminished portion of the column of high pressure gas acting as a fluid is expelled through the next set of minor truncated socket forms that are the next set of opening towards the breech. The process continues as each portion of high pressure gas is expelled from the muzzle brake. This process of stages reduces the recoil at the beginning, and throughout all the stages, to reduce the recoil, muzzle rise, and lateral movement.

The "Main Event of Internal Ballistics," or "Main Event," now follows. The projectile exiting the bore of the firearm is followed by a column of hot high pressure gas acting as a fluid, and is now captured by the gas capture chamber and is utilized by the caliber specific orifice end plate to reduce recoil, muzzle rise, and lateral movement as the projectile exits the muzzle brake of the firearm. Part of this captured hot high pressure gas is expelled out through, and rearward, by the major truncated socket forms and associated openings, imparting more forward thrust on the firearm.

The second part of this "Main Event of Internal Ballistics" is the resistance of the caliber specific orifice end plate, causing pressure to build in the muzzle brake and forces a portion of the column of hot high pressure gas acting as a fluid to be expelled by the next set of truncated socket forms and openings toward the breach of the firearm reducing recoil, muzzle rise, and lateral movement.

The third part of this event process is a diminished portion of the column of hot high pressure gas acting as a fluid to be expelled at the next set of truncated socket forms and openings. The process continues as each portion of hot high pressure gas is expelled from the muzzle brake. This process of events propels the firearm forward, further reducing the recoil. All these forces are utilized to reduce the recoil, muzzle rise, and lateral movement.

In various embodiments, the muzzle brake has an unusual and inventive way of capturing the column of high pressure gas heretofore not utilized, first as high pressure gas preceding the projectile, then as hot high pressure gas following the projectile, and then acting by redirecting both to create thrust within the muzzle brake forcing it forward against the recoil and down against the associated muzzle rise and lateral movement. Thus, two separate events are utilized to propel the firearm forward, reducing recoil, muzzle rise, and lateral movement. These two events are followed by a third event:

As used herein, the "Third Event of the Internal Ballistics processes," or "Third Event," occurs when, as the last of the hot high pressure gas exits the caliber specific muzzle end plate orifice, and through the truncated socket forms. Because all of the hot high pressure gas has exited the muzzle brake at supersonic speed, due to inertia, a "partial vacuum" now exists in the firearm barrel and muzzle brake, and atmospheric gas then begins to rush back into the muzzle brake and firearm barrel at supersonic speed through the truncated socket forms and the caliber specific end plate orifice. The muzzle brake end plate with a caliber specific orifice, acts as a restriction point for the atmospheric gas to fill the "partial vacuum" in the muzzle brake and firearm barrel. The plurality of truncated socket forms through the muzzle brake body penetrating into the gas capture chamber allow a very fast intake of atmospheric gas to fill the muzzle brake and firearm barrel, and in this moment the truncated socket forms "working in reverse gas flow" pull the muzzle brake and firearm forward, further reducing the recoil.

A simple example is given wherein a change in direction of air flow through the various truncated socket forms will exert forward force on the muzzle brake and firearm regardless of the direction of the gas flow.

BRIEF DESCRIPTION OF THE DRAWINGS

The above-mentioned features of the invention will become more clearly understood from the following detailed description of the invention read together with the drawings in which:

FIG. 2A is a partial cross-section view of a firearm barrel for the muzzle brake to be attached to.

DETAILED DESCRIPTION OF THE INVENTION

Figure 1A:
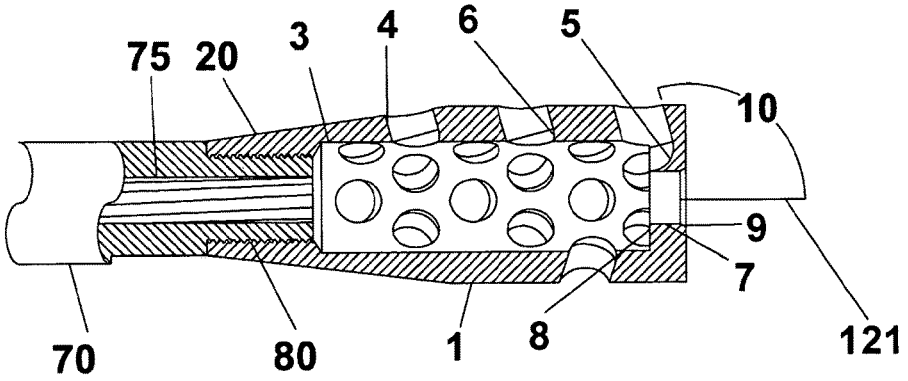
FIG. 1A is a cross-sectional view of a muzzle brake body, in attachable and removable form, for a firearm disclosing an internal gas capture chamber utilizing a plurality of precision radially skewed vents with truncated socket end forms, partially penetrating the gas capture chamber wall and significantly penetrating the caliber specific muzzle brake exit orifice end plate.
Figure 1B:
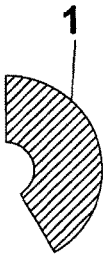
FIG. 1B is an end view of the cross-section in FIG. 1A.
Figure 2A:
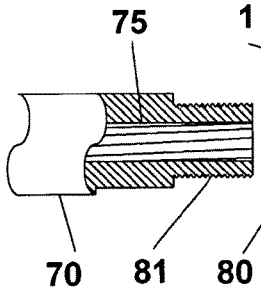

FIG. 1A illustrates one embodiment of muzzle brake 1 constructed in accordance with various features of the present general inventive concept. In the illustration of FIG. 1A, a muzzle end of a firearm barrel 70 is illustrated. The firearm barrel 70 defines a substantially cylindrical bore 75 defining rifling therein and opens outwardly to a muzzle end 81 (see FIG. 2A) thereof. In the various figures, the illustrated muzzle end 81 defines a plurality of external threads of the type commonly used to attach any of various firearm accessories thereto. With initial reference to FIG. 1A, in one embodiment, a muzzle brake 1 is provided having a generally internally and externally cylindrical shape and having a first end defining an internally threaded 80 opening adapted to mate with and engage the external threads of the externally threaded muzzle end 81 of the firearm barrel 70 in order to secure the muzzle brake 1 to the firearm barrel 70. The internally threaded 80 first end of the muzzle brake 1 opens to an internal cavity of the muzzle brake 1 defining a substantially cylindrical gas capture chamber 3. The gas capture chamber 3 defines a central axis which, when the muzzle brake 1 is secured to the firearm barrel 70 via the first end threads 80, is held coaxial with a centerline 121 of the bore 75. The diameter of the cylindrical gas capture chamber 3, which is perpendicular to the central axis thereof, is sized superior to the cross-sectional diameter of the bore 75, such that the cross-sectional width of the gas capture chamber 3 is superior in size to the bore 75.

As will be discussed in additional detail below, a second end of the muzzle brake 1 defines an end plate 2 having an internal face wall 8 forming a forward end of the gas capture chamber 3. The end plate 2 further defines a substantially cylindrical orifice 7 coaxial with the central axis of the gas capture chamber 3 and the centerline 121 of the bore 75. The orifice 7 is sized to closely conform to the outer diameter of a projectile 100 fired from the firearm barrel 70. An external rim of the orifice 7 defines a 60 degree chamfer 9 extending annularly thereabout, and opening to a forward, outer surface of the end plate 2. In the illustrated embodiment of FIG. 1A, the muzzle brake 1 utilizes an end plate that is an integral part of the body of the muzzle brake. However, it will be recognized that the end plate 2 may be secured relative to the remainder of the muzzle brake 1 via other means without departing from the spirit and scope of the present general inventive concept.

As will be discussed in further detail below, in various embodiments, including the embodiment illustrated in FIG. 1A, a plurality of vent ports 4 are defined in radially skewed 11 patterns about the annular circumferential side wall of the muzzle brake 1. Each of the vent ports defines generally an opening extending from an external side surface of the body of the muzzle brake 1 radially inwardly toward the central axis of the gas capture chamber 3 and slightly forward toward the muzzle brake second end, such that each vent port extends at a 105 degree angle 10 relative to the center line 121 of the bore of the firearm and the central axis of the gas capture chamber 3. In the embodiment of FIG. 1A, a first set of vent ports 4 extends in a radially skewed 11 pattern about the central axis of the gas capture chamber 3. Each vent port 4 of this first, forward most set extends from a forward portion of the external side surface of the body of the muzzle brake 1 into the intersection between the forward end of the gas capture chamber 3 and the end plate 2 face wall 8. At this location, each of the vent ports 4 terminates inwardly with the formation of a major truncated socket form 5 which is defined at least partially by the end plate 2 and intersects with the end plate inner face wall 8.

Similarly, additional sets of vent ports 4 are provided along the length of the muzzle brake 1, each such vent port 4 extending from the external side surface of the body of the muzzle brake 1 radially inwardly and into the gas capture chamber 3. Each of these additional sets of vent ports 4 extends in a radially skewed 11 pattern about the central axis of the gas capture chamber 3, and each of these sets of vent ports 4 is circumferentially skewed in relation to the immediately preceding and subsequent sets of vent ports. Furthermore, each of these vent ports 4 extends approximately to the curved interior side surface of the gas capture chamber 3, whereupon each of these vent ports 4 terminates inwardly with the formation of a minor truncated socket form 6 which intersects with, and opens to, the curved interior side surface of the gas capture chamber 3.

In the illustrated embodiment, each vent port 4 defines a generally cylindrical shape, and each corresponding major truncated socket form 5 defines a portion of a semi-spherical shape which intersects both with respective interior surfaces of the vent port 4 and with an interior rim of the end plate orifice 7. Similarly, each of the minor truncated socket forms 6 defines a truncated spherical shape which intersects both with respective interior surfaces of the vent port 4 and with an interior side surface of the gas capture chamber 3. However, it will be recognized that other suitable shapes exist for the vent ports 4 and the major and minor truncated socket forms 5, 6, and such alternate shapes may be used without departing from the spirit and scope of the present general inventive concept.

Figure 2B:
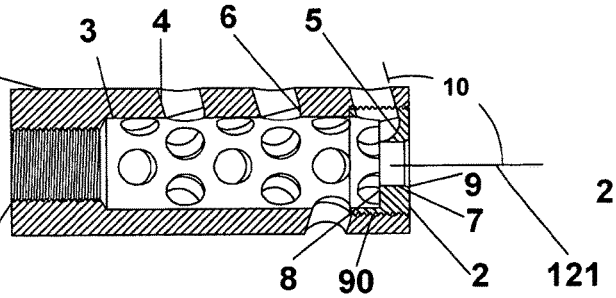
FIG. 2B is a cross-sectional view of a muzzle brake body, in attachable and removable form, for a firearm disclosing an internal gas capture chamber utilizing a plurality of precision radially skewed vents with truncated socket end forms, partially penetrating the gas capture chamber wall and significantly penetrating the threaded caliber specific insert orifice end plate of the muzzle brake.
Figure 2C:
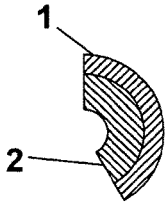
FIG. 2C is an end view of the cross-section in FIG. 2B.
Figure 9A:
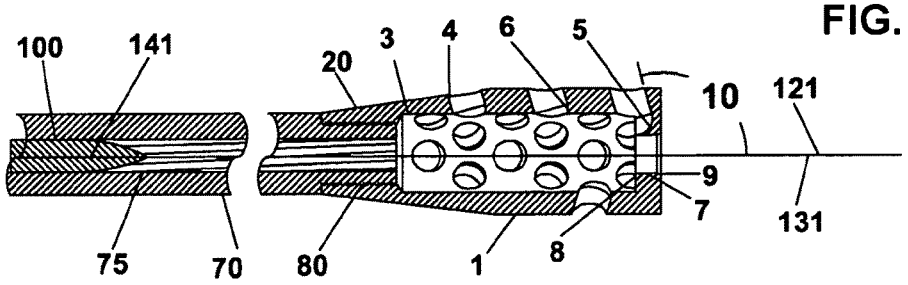
FIG. 9A through FIG. 9D are cross-sectional views of a firearm barrel with a muzzle brake, and a depiction of its lack of reaction when discharged.
Figure 9B:
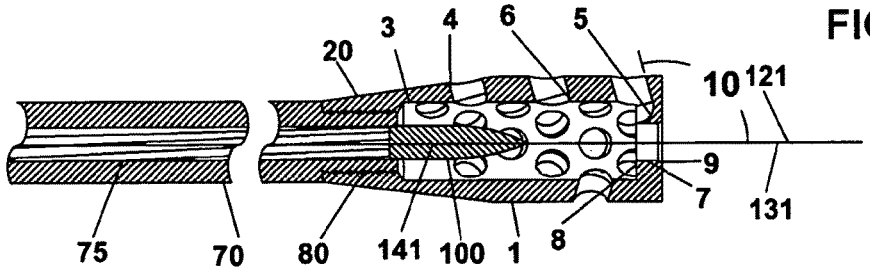
Figure 9C:
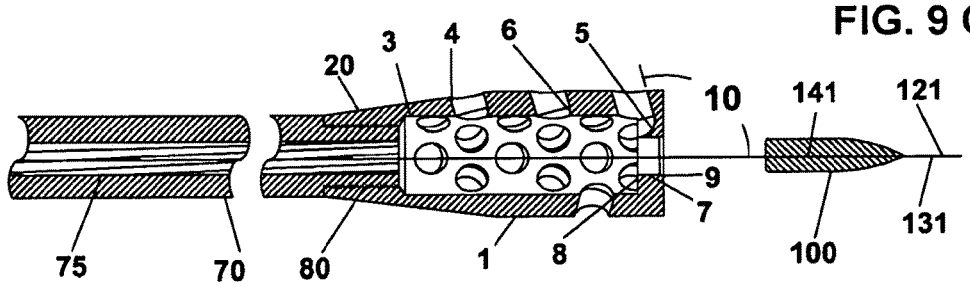
Figure 9D:
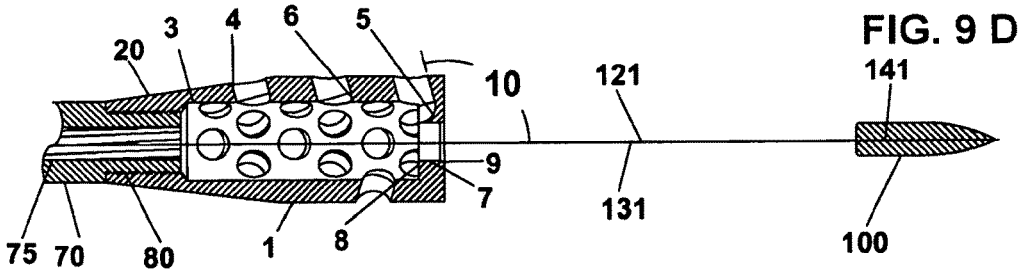

Referring now to the embodiment of FIG. 2B, there is shown a cross-sectional view of a muzzle brake 1 being externally and internally cylindrical in shape and having a gas capture chamber 3 superior in size to the bore 75. In this embodiment, the muzzle brake 1 features a threaded 90 gas capture chamber insert end plate 2 exhibiting a plurality of radially skewed (11, FIG. 3B) precision angle 10 vent ports 4, introduced at a 105 degree angle 10 relative to the center line 121 of the bore of the firearm and the direction of the path (131, FIG. 9A) of the projectile 100. As illustrated in FIG. 2B, major truncated socket forms 5 are formed at and in conjunction with said 105 degree angle 10 vent ports introduced substantially into said gas capture chamber 3 end plate 2 face wall 8 of the threaded 90 gas capture chamber 3 insert end plate 2.

In the illustrated muzzle brake 1, which is externally and internally cylindrical in shape and having a gas capture chamber 3 that features and exhibits a plurality of radially skewed (11, FIG. 3B), precision angle 10 introduced vent ports 4 at said 105 degree angle 10 relative to the center line 121 of the bore of the firearm and the direction of said path (131, FIG. 9A) of said projectile 100, minor truncated socket forms 6 are formed at and in conjunction with said 105 degree angle 10 vent ports 4. The muzzle brake 1 is internally threaded 80 for attachment to any appropriately externally threaded 81 muzzle end of a firearm barrel 70 of compatible size and caliber and is thus an attachment and accessory that can be attached or removed from the firearm. The gas capture chamber 3 within said muzzle brake 1 captures the high pressure gas acting as a column of fluid that is forced into the gas capture chamber 3. This is the First Event acted on by said muzzle brake 1 in the chain of events relating to the Internal Ballistics of a firearm.

In one embodiment of said muzzle brake 1 invention, there is disclosed the gas capture chamber 3 that features a threaded 90 gas capture chamber, insert end plate 2 exhibiting a plurality of radially skewed (11, FIG. 3B), precision angle 10 vent ports 4. Said vent ports 4 are by design introduced at a said 105 degree angle 10 relative to the center line 121 said bore 75 of the firearm and in the direction of the path (131, FIG. 9A) said projectile 100. Said vent ports 4 at said 105 degree angle 10 define said major truncated socket forms 5 at and in conjunction with said 105 degree angle 10 vent ports 4 substantially introduced into the said gas capture chamber 3 end plate 2, internal face wall 8 of the threaded 90 gas capture chamber 3 insert end plate 2. Alternate design of said vent ports 4 at said 105 degree angle 10 are to be contemplated in this comprehensive Physics teaching of muzzle brake Dynamics as to, The Study of Motion: The branch of mechanics that deals with motion and the way in which forces produces this motion.

Said vent ports 4 at said 105 degree angle 10 can, by design, be introduced at any angle from an angle of 90 degrees up to an angle of 135 degrees towards the breech of the firearm relative to said center line 121 of the bore 75 of the firearm and the direction of the path (131, FIG. 9A) of said projectile 100. The preferred embodiment of the muzzle brake 1 invention discloses a gas capture chamber 3 that distinctly and for clarity exhibits a plurality of radially skewed (11, FIG. 3B), precision angle 10 introduced vent ports 4 at said 105 degree angle 10 and that define minor truncated socket forms 6 at and in conjunction with said 105 degree angle 10 vent ports 4.

Said minor truncated socket forms 6 preferably fail total penetration into the said gas capture chamber 3 interior wall thereby exhibiting vent ports 4 at said 105 degree angle 10 with a nozzle shaped truncated socket form 6 at the internal diameter interface with said gas capture chamber 3. Said minor truncated socket forms 6 can, by design, penetrate in depth by varying amounts into said gas capture chamber 3 at the internal diameter interface, and can be on the order of 10 percent penetration, and up to 99.9 percent penetration at the internal diameter interface of said gas capture chamber 3.

Figure 3A:
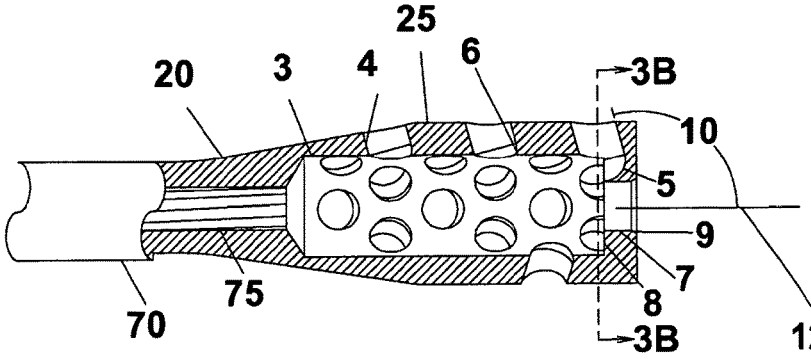
FIG. 3A is a cross-sectional view of a muzzle brake body, as an integral part of the firearm barrel, disclosing an internal gas capture chamber utilizing a plurality of precision radially skewed vents with truncated socket end forms, partially penetrating the gas capture chamber wall and significantly penetrating the caliber specific muzzle brake exit orifice end plate.
Figure 3B:
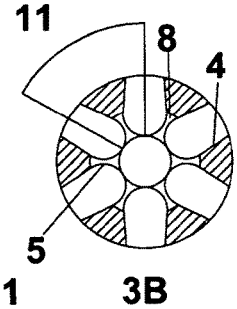
FIG. 3B is a cross-section view of FIG. 3A in the plane shown.

FIG. 3A illustrates an alternate, monolithic embodiment of a muzzle brake 25 with a barrel blend form 20 of the muzzle brake 25. In this and other embodiments, as a projectile 100 is fired through the bore 75 of the barrel 70, the gas capture chamber 3 first captures the highly compressed column of Atmosphere gas in the firearm bore 75 and said gas capture chamber 3 as it precedes the projectile 100 prior to the projectile 100 entering into the gas capture chamber 3 of the monolithic embodiment muzzle brake 25. Whereas this is the beginning of the First Event in the chain of events that reduce recoil, muzzle rise, and lateral movement in the firearm.

Figure 4:
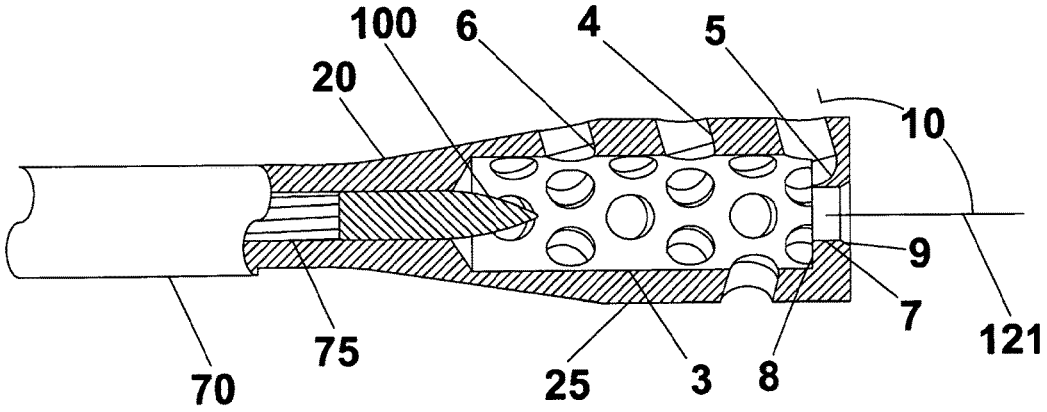
FIG. 4 is a cross-sectional view of a muzzle brake body, as an integral part of the firearm barrel, with a projectile entering the internal gas capture chamber utilizing a plurality of internal precision radially skewed vents with truncated socket end forms, partially penetrating the gas capture chamber wall and significantly penetrating the caliber specific muzzle brake exit orifice end plate.

Citing FIG. 4, what is shown is a cross-sectional view of the alternate embodiment of the monolithic muzzle brake, that is, a cross-sectional view of the firearm barrel 70 with integral muzzle brake 25, featuring a monolithic embodiment and being in a cylindrical form with said gas capture chamber 3. In this illustration, there is shown a projectile 100 beginning to exit the firearm barrel bore 75. The firearm muzzle brake 25 accomplishes a series of events that first captures the highly compressed column of atmospheric gas preceding the projectile 100 prior to said projectile 100 passing through the said gas capture chamber 3 of said muzzle brake 25.

Wherein, in several designs for modern firearms, the highly compressed column of atmospheric gas preceding the projectile 100 attains a high pressure of approximately 20,000 pounds per square inch, and has nearly equalized with the hot high pressure expanding gas in the firearm barrel bore 75 that is propelling the projectile 100 forward, this compressed column of atmospheric gas acts within the gas capture chamber 3 by impacting the gas capture chamber 3 end plate wall 8 and is then restricted by the orifice 7. Thus, this column of high pressure atmospheric gas imparts substantial energy to the end plate wall 8. This high pressure gas is then diverted into said major truncated socket forms 5 and out exhaust port vents 4 at said 105 degree angle 10 resulting in more energy being imparted to the muzzle brake, thereby reducing recoil. The following remainder of this highly compressed column of atmospheric gas is then forced into and acts upon the minor truncated socket forms 6 and is forced out exhaust port vents 4 at said 105 degree angle 10, thereby imparting additional energy in the forward direction, thereby further reducing the recoil of the firearm.

Figure 5:
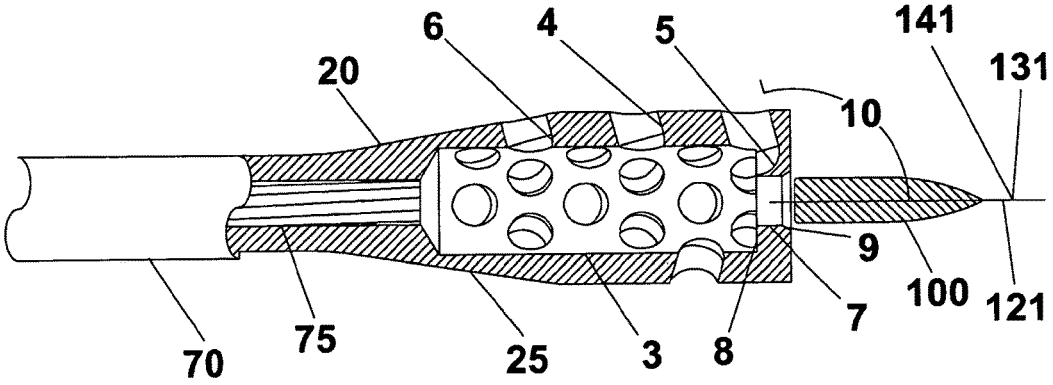
FIG. 5 is a cross-sectional view of a muzzle brake body, as an integral part of the firearm barrel, with a projectile exiting the internal gas capture chamber utilizing a plurality of precision radially skewed vents with truncated socket end forms, partially penetrating the gas capture chamber wall and significantly penetrating the caliber specific muzzle brake exit orifice end plate.
Figure 6:
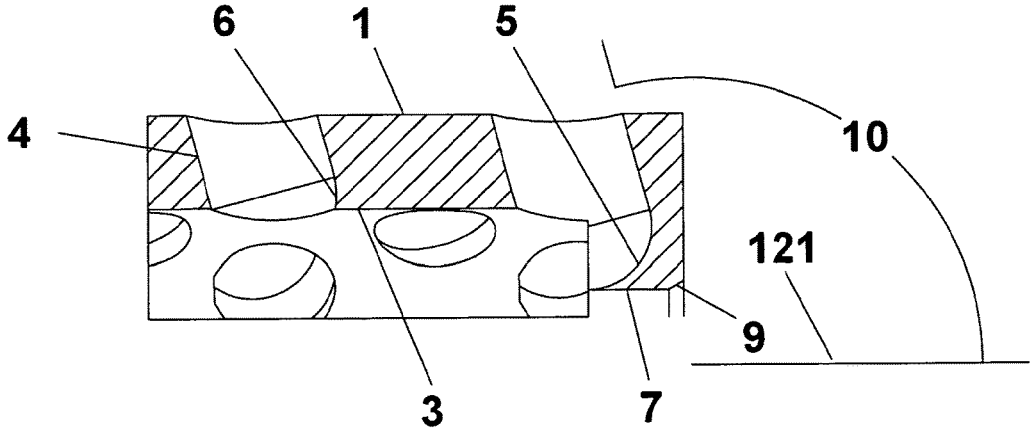
FIG. 6 is an enlarged partial vertical cut cross-sectional view for clarity, of a muzzle brake body exhibiting the internal gas capture chamber utilizing a plurality of precision radially skewed vents with truncated socket end forms, partially penetrating the gas capture chamber wall and significantly penetrating the caliber specific muzzle brake exit orifice end plate.
Figure 7:
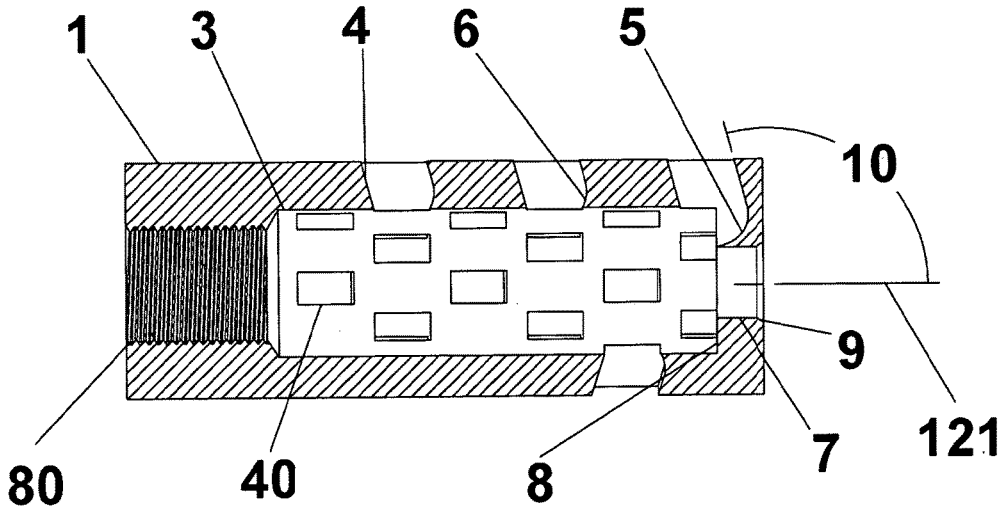
FIG. 7 is a cross-sectional view of a muzzle brake body in attachable and removable form for a firearm disclosing an internal gas capture chamber utilizing a plurality of precision radially skewed vents with truncated socket end forms, partially penetrating the gas capture chamber wall and significantly penetrating the caliber specific muzzle brake exit orifice end plate being as an integral part of the muzzle brake depicting one of many possible alternate vent and truncated socket forms.

Citing FIG. 5, the Second Event now follows; within 0.0012 of a second for many designs of modern firearms, the projectile 100 passes through the gas capture chamber 3 as the hot high pressure expanding gas in the firearm bore 75 propels the projectile 100 forward and acts upon said gas capture chamber 3 by impacting the gas capture chamber 3 end plate wall 8 and being restricted by the orifice 7. The second and more substantial mass and energy of the hot high pressure gas following the projectile is forced into the major truncated socket forms 5 and is expelled from the vent ports 4 at said 105 degree angle 10, and then the following hot high pressure gas is forced into and acts upon said minor truncated socket forms 6 and out exhaust port vents 4 at said 105 degree angle 10, thereby imparting force in the forward direction and thus further reducing the recoil of the firearm.

Stated differently, during the Second Event, the projectile 100 enters and substantially fills and restricts the orifice 7. In this very brief moment, the expanding hot high pressure gas is unable to exit, or at least is severely restricted from exiting, the gas capture chamber 3 through the orifice 7. However, the expanding hot high pressure gas nonetheless exerts significant pressure on the interior face wall 8 of the end plate 2. Thus, during this brief Second Event period, the expanding hot high pressure gas is forced through the major truncated socket forms 5 and is expelled from the vent ports 4 associated therewith, and additional hot high pressure gas is forced through the minor truncated socket forms 6 and is expelled from the vent ports associated therewith. Thus, in this very brief Second Event, the gas expelled through the various vent ports 4 results in significant force being imparted in the forward direction of the firearm barrel 70 and associated muzzle brake 25, thereby further reducing the recoil of the firearm.

The Third Event now follows. Within 0.00005 of a second following the Second Event for most designs of modern firearms, the projectile 100 now exits the muzzle brake orifice 7 end plate (2 FIG. 2B). A short time after this event, the firearm barrel bore 75 and the muzzle brake 25 gas capture chamber 3 and exhaust ports 4 have exhausted all the hot high pressure gas and with completion of this event, due to the inertia of the hot high pressure gas there now exists a "partial vacuum" in the firearm barrel bore 75 and in the muzzle brake 25 and associated vent ports 4. After this, a reverse flow of atmospheric gas is pulled into the firearm barrel bore 75, at a high rate of speed, for some firearm designs approaching Mach 2.5, passing through vent ports 4 at said 105 degree angle 10 and acting on said minor truncated socket forms 6 and through the vent ports 4 at said 105 degree angle 10 and acting on said major truncated socket forms 5 and through the orifice 7 to a lesser extent. The various vent ports 4 at said 105 degree angle 10 offer substantially less resistance to the atmospheric gas flow into the muzzle brake 25 with said gas capture chamber 3 and firearm barrel bore 75 than does the caliber specific orifice 7. At this time, the atmospheric gas being pulled into the muzzle brake 25 and the firearm barrel bore 75 through the vent ports 4, said minor truncated socket forms 6, said Major truncated socket forms 5, and orifice 7, passing through the gas capture chamber 3, acts to impart energy in a forward direction to the truncated socket forms 5 and to the muzzle brake and firearm, thus being the Third Event that further reduces the recoil.

Citing FIG. 8A through FIG. 8E, in a firearm not equipped with a muzzle brake constructed in accordance with the present general inventive concept, one must realize that instability is induced in the projectile 100 by the movement of the firearm barrel 70 which occurs during recoil and adds to inaccuracy in the flight path 131 of projectile 100 as it leaves the bore 75 at the muzzle end of the firearm.

Citing FIG. 9A through FIG. 9D, a firearm barrel equipped with a muzzle brake 1 constructed in accordance with several features of the present general inventive concept is stabilized, to the extent that the induced wobble of the centerline 141 of said projectile 100 is very significantly reduced and accuracy is improved.

Citing FIG. 5, On consideration of findings, is the belief that, the projectile 100 flight path 131 is stabilized on exiting the muzzle brake 25 orifice 7, and is influenced by orifice 7 and the 60 degree included angle chamfer 9. This small distance of projectile flight path 131 through orifice 7 and 60 degree chamfer 9 has the effect of realigning and damping the minute wobble of the projectile axis 141 of projectile 100 upon leaving the muzzle brake orifice 7 60 degree included angle chamfer 9.

Citing FIG. 8A through FIG. 8E, there is depicted a firearm barrel 70 without a muzzle brake attached.

Figure 8A:
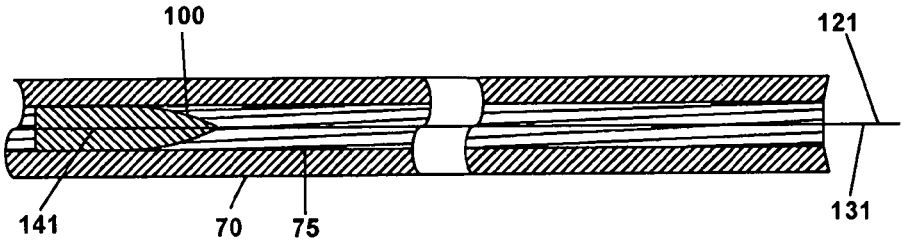
FIG. 8A through FIG. 8E are cross-sectional views of a firearm barrel without a muzzle brake, and a depiction of its reaction when discharged.

FIG. 8A depicts initiation of firing before any movement has begun. The centerline 141 of the projectile 100 is aligned with the centerline 121 of the firearm bore 75 and with the intended flight path 131 of projectile 100.

Figure 8B:
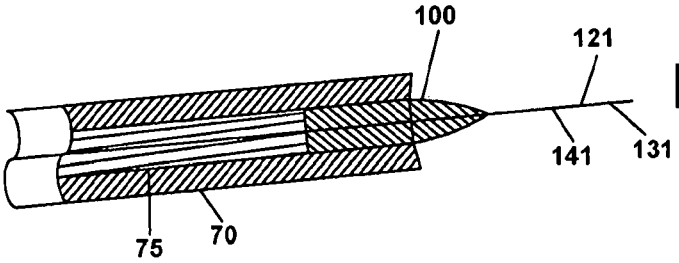

As shown in FIG. 8B, as the projectile 100 begins to emerge from the firearm barrel 70, the firearm barrel 70 begins to exhibit the effect of recoil and barrel rise. In this depiction, the projectile 100 and centerline 141 are still aligned with the centerline 121 of the bore 75 and the flight path 131 of the projectile 100.

Figure 8C:
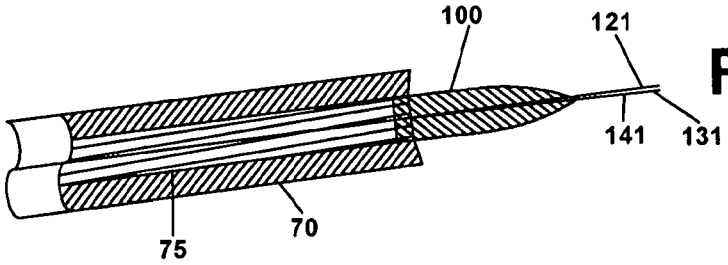

Referring to FIG. 8C, as the projectile 100 exits the firearm barrel 70, exhibiting the effects of recoil, the base of the projectile 100 is forced up and out of alignment with the centerline 121 of the bore 75 of the firearm. The projectile 100 is thus deflected from the intended flight path 131 of the projectile 100, so that the centerline of the projectile 141 is no longer aligned with the flight path 131, introducing instability in the projectile 100 and inaccuracy in the flight path 131.

Figure 8D:
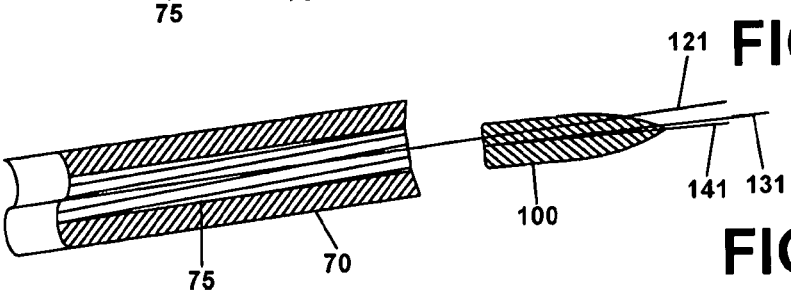

Referring to FIG. 8D, the firearm barrel 70 now exhibits the continuing effects of recoil, whereas the hot high pressure gas is being expelled from the bore 75 of the firearm, whereby the ensuing turbulence exerts asymmetrical force to the base of projectile 100 causing further disruption to the stability of the projectile 100 and causing the centerline of the projectile 141 to be pushed further out of alignment with the intended flight path 131 and greater inaccuracy.

Figure 8E:
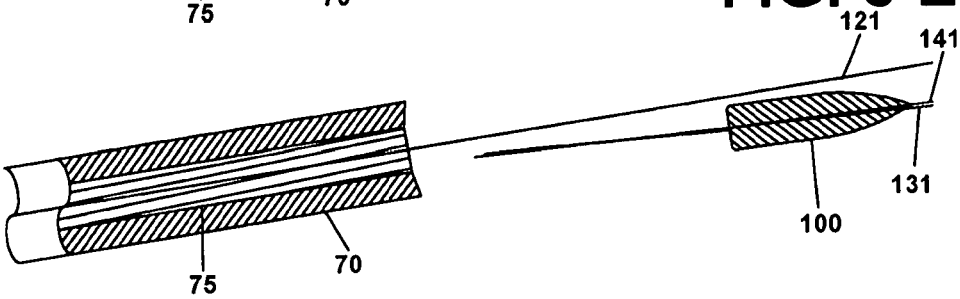

Referring to FIG. 8E, as the projectile 100 moves further from the firearm barrel 70, the gyroscopic effect of the spin imparted to the projectile 100 by the rifling in the firearm bore 75 will begin to stabilize the projectile after going through several oscillations.

Citing FIG. 9A through FIG. 9D, with an embodiment of a muzzle brake 1 attached to the firearm barrel 70, very little movement due to recoil is imparted to the firearm barrel 70. Thus, the base of the projectile 100 is not pushed off the centerline of the flight path 131 to nearly as great an extent, thereby not disrupting the intended flight path 131 of the projectile 100 and improving the accuracy of the system.

All of the combined actions described and hereafter named, the First Event, the Second Event, and the Third Event, utilize a percentage of the captured kinetic energy from each event to reduce recoil, muzzle rise, and lateral movement that would be lost by direct venting in prior art inventions, as they do not utilize the novel and substantial high pressure gas controlling functions of the caliber specific orifice 7 end plate 2 and the gas capture chamber 3 with major truncated socket forms 5 and the minor truncated socket forms 6 of the current invention. In the Science of Internal Ballistics one must, with due diligence and research, identify all the various components, actions, events, and forces in play propelling a projectile 100 out of the barrel 70 of a firearm and those forces that can be used to reduce or eliminate recoil, muzzle rise and lateral movement.

In a society of gentlemen inventors it will be understood that embodiments of the present invention include, but are not limited to, the scope of the various embodiments of a muzzle brake 1 embodiment herein, described, designed, constructed, and illustrated in the drawings. Further variations and improved modifications of the above described muzzle brake 1 invention are to be contemplated, and applied without departing from the advanced technological aspects of the present general inventive concept.

What is claimed is:

1. A firearm having a barrel defining an elongate, substantially cylindrical bore, the bore defining a centerline, a cross-sectional diameter, and a forward muzzle end, the firearm further comprising a muzzle brake for controlling recoil in the firearm, the muzzle brake comprising:

a body member defining a substantially cylindrical inner cavity having a central axis coaxial with the centerline of the bore, the body member comprising:

a rear portion defining a rearward surface of the inner cavity, the rearward surface opening to the forward muzzle end of the bore;

a front wall defining a forward surface of the inner cavity and a through opening extending through the front wall along the central axis of the inner cavity; and a side wall defining a curved side surface of the inner cavity;

the inner cavity having a smooth bore inner surface that has a uniform diameter between the rearward surface and front wall, and the inner cavity extending outwardly from the central axis to have a greater circumference than the bore of the barrel; and a first plurality of vent bores extending into an external surface of the side wall and at least partially through the side surface of the inner cavity, each of the first plurality of vent bores comprising an outer portion having a substantially cylindrical shape and forming an external vent port of the body member and an inner portion having a hemispherical shape, each inner portion of each of the first plurality of vent bores at least partially intersecting the inner cavity to form a truncated nozzle portion having a leading edge extending along the side surface of the inner cavity;

whereby when fluid is forced from the bore of the firearm into the inner cavity, the leading edge of each of the first plurality of vent bores diverts fluid against the hemispherical inner portion of the vent bore and outward of the body member through the vent port of the vent bore, thereby urging the body member forward.

2. The firearm of claim 1, wherein the body member is integrally formed as a single piece.

3. The firearm of claim 2 further comprising:

a second plurality of vent bores extending into the external surface of the side wall, at least partially through the side surface of the inner cavity and into the front wall, each of the second plurality of vent bores comprising an outer portion having a substantially cylindrical shape and forming an external vent port of the body member and an inner portion having a hemispherical shape, each inner portion of each of the second plurality of vent bores at least partially intersecting the forward surface of the inner cavity to form a truncated nozzle portion having a leading edge extending along a rearward edge of the through opening;

whereby when fluid is forced from the bore of the firearm into the inner cavity, the leading edge of each of the second plurality of vent bores diverts fluid against the hemispherical inner portion of the vent bore and outward of the body member through the vent port of the vent bore, thereby urging the body member forward.

4. The firearm of claim 3, wherein the outer portion of each of the vent bores of the first and second plurality of vent bores defines a central axis extending radially outwardly from the central axis of the inner cavity.

5. The firearm of claim 4, each central axis of each outer portion of each of the vent bores of the first and second plurality of vent bores extending outwardly and rearwardly at an angle between 90 degrees and 135 degrees to the central axis of the inner cavity.

6. The firearm of claim 5, each central axis of each outer portion of each of the vent bores of the first and second plurality of vent bores extending outwardly and rearwardly at an angle of 105 degrees to the central axis of the substantially cylindrical inner cavity.

7. The firearm of claim 6, wherein the first plurality of vent bores is disposed in an evenly spaced, radially skewed array about the side surface of the inner cavity, the array defining a plurality of incremental rows along the central axis of the inner cavity.

8. The firearm of claim 7, wherein the second plurality of vent bores is disposed in an evenly spaced, radially skewed array about the through opening.

9. The firearm of claim 8, wherein the through opening is sized to correspond to the bore of the firearm.

10. The firearm of claim 9, the through opening having a forward portion defining an outwardly flared chamfer.

11. The firearm of claim 10, the chamfer of the forward portion of the through opening defining a 60 degree angle with a front surface of the front wall.

12. The firearm of claim 11, wherein the body member and the barrel of the firearm are integrally formed as a single piece.

13. The firearm of claim 1, wherein the outer portion of each of the vent bores of the first plurality of vent bores defines a central axis, each central axis of each outer portion of each of the first plurality of vent bores extending outwardly and rearwardly at an angle of 105 degrees to the central axis of the substantially cylindrical inner cavity.

14. The firearm of claim 1, wherein the first plurality of vent bores is disposed in an evenly spaced, radially skewed array about the side surface of the inner cavity, the array defining a plurality of incremental rows along the central axis of the inner cavity.

15. The firearm of claim 1, wherein the barrel is configured to direct a projectile along the centerline of the barrel, the through opening being sized to correspond to an outer diameter of the projectile.

* * * * *